US006679022B1

(12) United States Patent
Corporaal

(10) Patent No.: US 6,679,022 B1
(45) Date of Patent: Jan. 20, 2004

(54) BUILDING BLOCK OR PANEL

(76) Inventor: Hendrik Corporaal, 18 Epping Grove, Kallaroo W.A. 6025 (AU)

( * ) Notice: Subject to any disclaimer, the term of this patent is extended or adjusted under 35 U.S.C. 154(b) by 0 days.

(21) Appl. No.: 10/088,031

(22) PCT Filed: Sep. 15, 2000

(86) PCT No.: PCT/AU00/01106

§ 371 (c)(1),
(2), (4) Date: Mar. 14, 2002

(87) PCT Pub. No.: WO01/20092

PCT Pub. Date: Mar. 22, 2001

(30) Foreign Application Priority Data

Sep. 15, 1999 (AU) ..... PQ 2854

(51) Int. Cl.[7] ..... E04B 5/04; E04B 2/08; E04B 2/18; E04C 2/04

(52) U.S. Cl. ..... 52/604; 52/609; 52/590.2; 52/592.5

(58) Field of Search ..... 52/603, 604, 605, 52/609, 589.1, 590.2, 591.1, 591.2, 592.1, 592.3, 592.5, 592.6

(56) References Cited

U.S. PATENT DOCUMENTS

| | | | | | |
|---|---|---|---|---|---|
| 1,418,168 | A | * | 5/1922 | Preston | 52/591.5 |
| 1,447,041 | A | * | 2/1923 | Roeth | 52/590.2 |
| 1,785,499 | A | * | 12/1930 | Sayers | 52/505 |
| 2,452,463 | A | * | 10/1948 | Herbert | 52/436 |
| 2,703,487 | A | * | 3/1955 | Ossoinack | 52/592.3 |
| 3,859,769 | A | | 1/1975 | Watkins | |
| 4,633,639 | A | * | 1/1987 | Deimen | 52/591.2 |
| 5,457,926 | A | * | 10/1995 | Jensen | 52/604 |
| 5,588,271 | A | * | 12/1996 | Pitchford | 52/306 |
| 5,775,047 | A | * | 7/1998 | Jensen | 52/596 |
| 5,899,040 | A | * | 5/1999 | Cerrato | 52/604 |
| 6,050,044 | A | * | 4/2000 | McIntosh | 52/591.1 |

FOREIGN PATENT DOCUMENTS

| | | |
|---|---|---|
| AU | 84229/75 | 3/1977 |
| FR | 2376263 | 7/1978 |
| GB | 2 134 561 A | 8/1984 |
| WO | WO 8301803 A1 | 5/1983 |

* cited by examiner

*Primary Examiner*—Brian E. Glessner
*Assistant Examiner*—Kevin McDermott
(74) *Attorney, Agent, or Firm*—Rothwell, Figg, Ernst & Manbeck, P.C.

(57) ABSTRACT

A building block or panel having a shape of a parallelpiped including four edge faces (11, 13, 15 and 17) and two opposed major faces (19 and 21), the edge faces being formed to be interlockingly engageable with the edge faces on similar building blocks, each edge face including lateral zones which are located to one or the other side of the central longitudinal axis of the edge face, one zone of each edge face being formed with a recess (23) and the other zone of each edge face being of a complementary configuration to the one zone, the recesses on opposed edge faces being of corresponding configuration.

34 Claims, 4 Drawing Sheets

BUILDING BLOCK OR PANEL

FIELD OF THE INVENTION

This invention relates to building blocks or panels

BACKGROUND

The present invention relates to building blocks or panels which are capable of being lockingly interengaged with each other whereby they are positively retained in such engagement and do not necessarily require utilisation of a bonding agent such as mortar or to retain them in engagement. Previous forms of building blocks which satisfy the above criteria are disclosed in Australian patent specifications AU-B-33151/63, AU-B-78872/75 and AU-B-90575/82. The blocks which are described in the above specifications have usually required utilisation of a specialised moulding machine in their formation and have required an accurate maintenance of tolerances. Because of the nature of the blocks a close tolerance was required in the formation of the blocks and a minor variation from the required tolerances could result in a significant misalignment when a number of blocks were laid due to a compounding of the variation as each block was laid with the others. In addition, difficulties with the building blocks of the prior art referred to above related to the circumstance that blocks do not readily lend themselves to being laid in a wall whereby the vertical junctions between adjacent blocks in one course can be offset from the vertical junction of adjacent courses.

The present invention is intended to provide a building block which does not rely upon the utilisation of a complex machine or apparatus to form the block and in which tolerances in the formation of the block need not be as precise as those as the tolerances which have been required in respect of the building blocks disclosed in the above mentioned patent specifications.

The preceding discussion of the background to the invention is intended to facilitate an understanding of the present invention only. It should be appreciated that the discussion is not an acknowledgement or admission that any of the material referred to was part of the common general knowledge in Australia as at the priority date of the application.

DISCLOSURE OF THE INVENTION

According to one aspect the invention resides in a building block or panel having a shape of a parallelepiped comprising four edge faces and two opposed major faces, said edge faces being formed to be interlockingly engagable with the edge faces of similar building blocks, each edge face comprising a first lateral zone located to one side of the central longitudinal axis of the respective edge face and a second lateral zone located to the other side of the central longitudinal axis of the respective edge face, the first zone of each edge face being formed with a recess and the second zone of each edge face being formed with a projection of a complementary configuration to the recess of the first zone, the recesses on opposed edge faces being of corresponding configuration wherein, each recess has a base which is substantially parallel to the respective edge face and each recess has opposed end faces which are of complementary profile, are substantially parallel to each other and are inclined with respect to the edge face.

According to a further preferred feature of the invention the recess on each edge face is located substantially centrally along the edge face.

According to a further preferred feature of the invention the recess has a width substantially corresponding to the width of the first zone.

According to another aspect the invention resides in a building block or panel having a shape of a parallelepiped comprising four edge faces and two opposed major faces, said edge faces being formed to be interlockingly engagable with the edge faces of similar building blocks, each edge face comprising a first lateral zone located to one side of the central longitudinal axis of the respective edge face and a second lateral zone located to the other side of the central longitudinal axis of the respective edge face, the first zone of each edge face being formed with a recess and the second zone of each edge face being formed with a projection of a complementary configuration to the recess of the first zone, the recesses on opposed edge faces being of corresponding configuration wherein, each recess has a base which is substantially parallel to the respective edge face, the open face of each recess which is in opposed relationship to the base is located substantially centrally along the respective zone, each recess has opposed end faces which are of complementary profile, are substantially parallel to each other and are inclined with respect to the edge face, the recess having a width substantially corresponding to the width of the first zone.

According to one preferred feature of the invention, the configuration of one pair of edge faces are of corresponding configuration with the formation of each zone on one edge face being reversed in relation to the formation in the corresponding zone of the opposed edge face.

According to a further preferred feature of the invention each opposed end face is substantially co-planar.

According to the further preferred feature of the end faces are inclined with respect to the edge face. According to one particular embodiment, one end face is inclined at an angle of 45° to the edge face and the other end face is inclined at an angle of 135° to the edge face.

The invention will be more fully understood in the light of the following description of one specific embodiment.

BRIEF DESCRIPTION OF THE DRAWINGS

The description of the embodiment is illustrated by reference to the accompanying drawings of which.

DETAILED DESCRIPTION OF SPECIFIC EMBODIMENT

Figure 1:
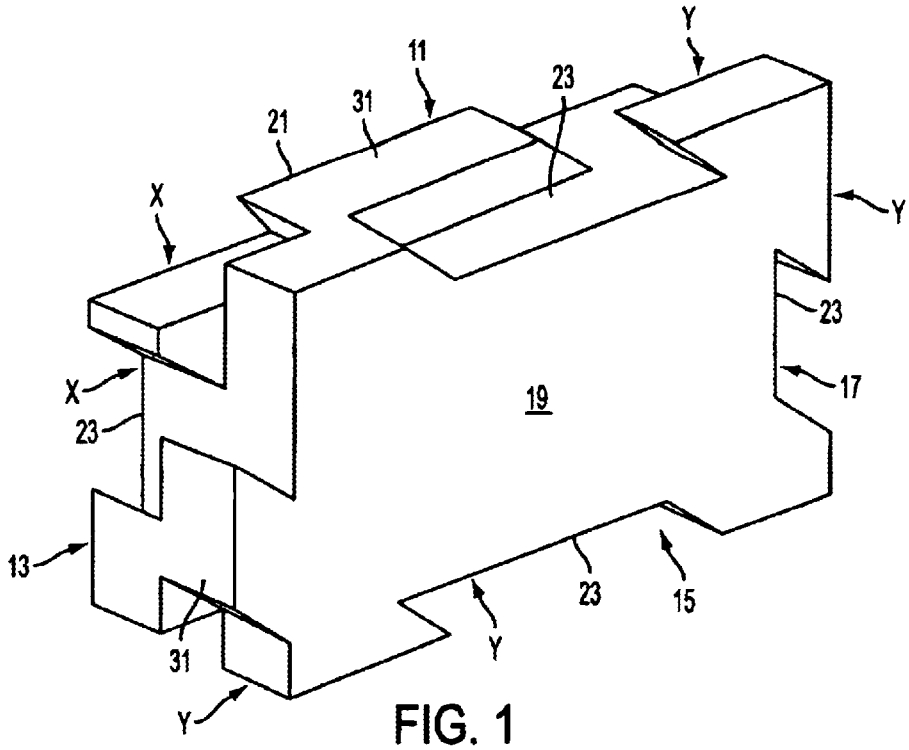
FIG. 1 is an upper isometric view of a block according to the embodiment showing one major face.
Figure 2:
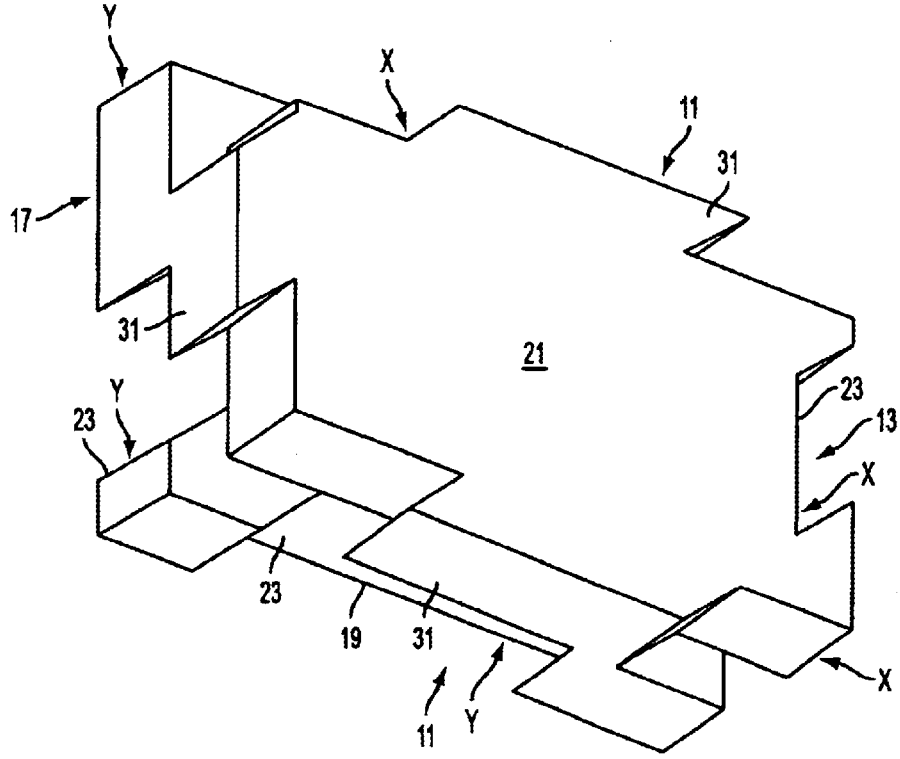
FIG. 2 is a lower isometric view of a block according to the embodiment showing the other major face.
Figure 3:
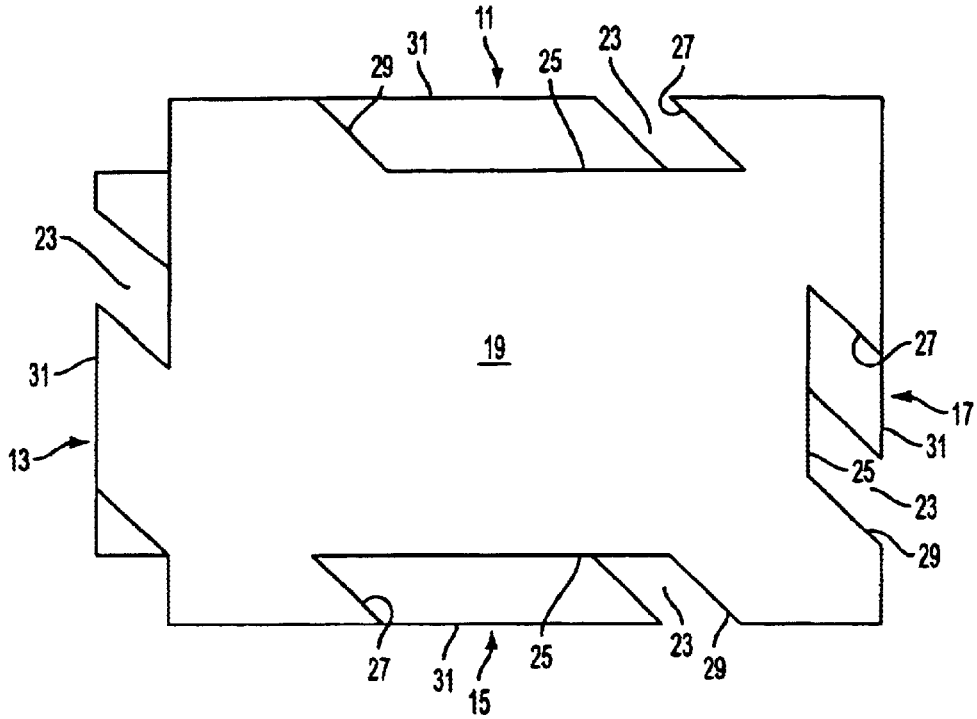
FIG. 3 is a side elevation of the block according to the embodiment showing the one major face.
Figure 4:
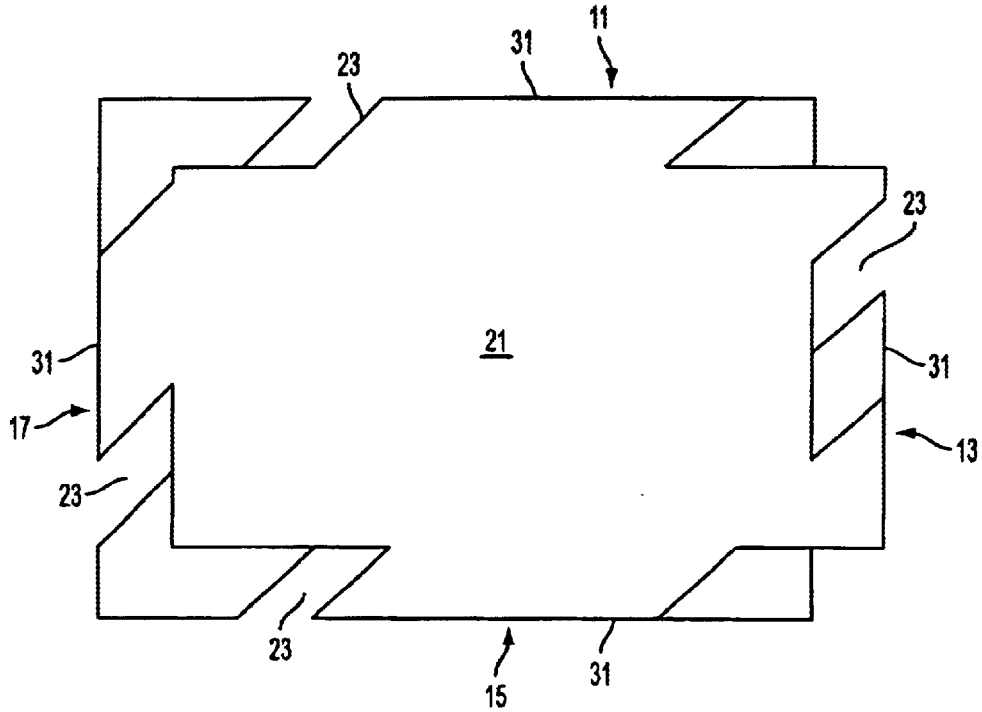
FIG. 4 is a side elevation of the block according to the embodiment showing the other major face.

The embodiment as shown at the accompanying drawings relates to a building block which is capable of being interengaged with corresponding building blocks in a manner which does not necessarily require the utilisation of a bonding agent to ensure that the building blocks remain interengaged.

As illustrated in the accompanying drawings, the building blocks generally have the form of a rectangular prism which have four edge faces 11, 13, 15 and 17 and two opposed major faces 19 and 21. Each edge face 11, 13, 15 and 17 is subdivided into two lateral zones X and Y which are located to either side of the central longitudinal axis of each face 11, 13, 15 and 17.

At each edge face 11, 13, 15 and 17 one zone X is formed with a recess 23 which has the configuration of a parallelogram and comprises a base 25 which is parallel to the outer edge face and two end faces 27 and 29 which are parallel to each other and which are inclined to the edge face such that one end face 29 is inclined 45° to the edge face and the other end face 27 is inclined at 135° to the edge face.

The other zone Y of each edge face 11, 13, 15 and 17 is of a complementary configuration to the one zone X and as a result it is provided with a projection 31 which is of complementary form to the recess 23 of the one zone X.

In addition, the opposed longer edge faces (the upper and lower edge faces) 11 and 15 are of substantially corresponding configuration in that the recesses are located at the one major face 19 and the projections 31 are located at the other major face 21 with the exception that the orientation of the recesses and the projections are reversed. In regard to the shorter edge faces (the end edge faces) 13 and 17 they are of substantially corresponding configuration except that the recess 23 of one end edge face 17 is adjacent one major face 19 while the recess of the other end edge face 13 is adjacent the other major face 21. The recesses on each end edge face have the same orientation. As a result the end edge faces 13 and 17 of a block are complementary to each other.

Figure 7:
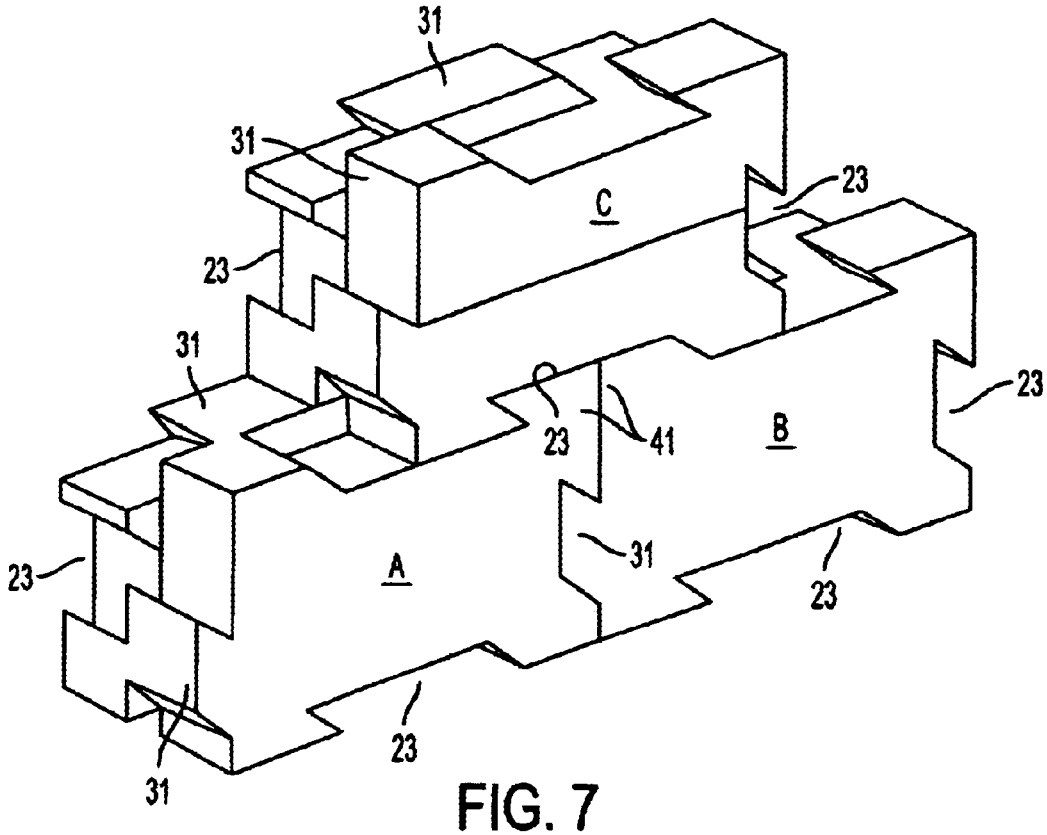
FIG. 7 is an illustration a set of blocks interengaged with each other.

As a result the configuration of the end edge faces 13 and 17 are such that when a pair of blocks A and B are brought together (as shown at FIG. 7) with the end edge faces 13 and 17 adjacent, the recesses 23 of the opposed end edge faces 13 and 17 will accommodate the projections 31 of the opposed end edge faces. In addition, as a result of such the combined upper and lower edge faces 13 and 17 of the interengaged blocks A and B define between themselves a projection 41 and a recess (not shown) in the region of the junction which is of complementary form to the recess 23 and projection 31 of a third block C whereby the third block C can be lowered into positive interengagement with the first and second block A and B as shown at FIG. 7 to overlie the junction with the recess 23 and the projection at lower face of the third being received in the combined recess and projection formed at the junction of the first and second block A and B.

Figure 5:
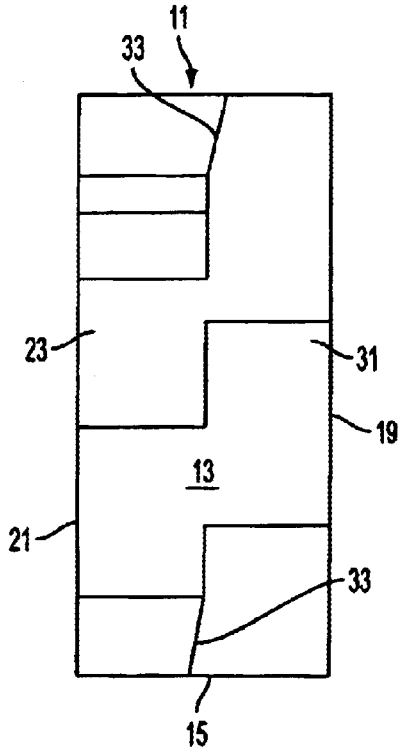
FIG. 5 is one end elevation of the block according to the embodiment.
Figure 6:
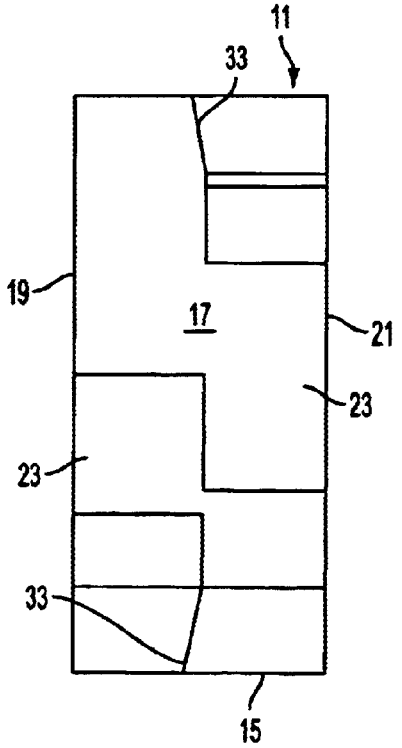
FIG. 6 is the opposite end elevation to the view shown at FIG. 5.

To facilitate the interengagement between blocks and to provide some degree of tolerance the longitudinal faces 33 of all of the projections which provide the junction between the projections and recesses between adjacent zones X and Y of an edge face are inclined (see FIGS. 5 and 6).

The arrangement as described in relation to the embodiment and as shown in the drawings provides a building block which is capable of being interengaged with other building blocks whereby the vertical junction between adjacent building blocks can be offset from the vertical junction of adjacent building blocks of adjacent courses and whereby the building blocks are interengaged to each side of each edge face which serves to provide for stability of the combined blocks. In addition the interengaged blocks are positively retained to at least some extent by the interengagement of the protrusions of each block with the recesses of the adjacent blocks. Furthermore the blocks are aligned as a result of the overlapping of the protrusions of the adjacent edge faces of adjacent blocks. In addition it is envisaged that the blocks will be able to be formed by the use of moulds and will not require specialised machinery in their manufacture.

According to a further embodiment of the invention more than one recess and/or projection is provided along each zone of each edge Throughout the specification, unless the context requires otherwise, the word "comprise" or variations such as "comprises" or "comprising", will be understood to imply the inclusion of a stated integer or group of integers but not the exclusion of any other integer or group of integers.

It should be appreciated that the scope of the present invention need not be limited to the particular scope of the embodiments described above. In particular whilst the embodiments have been described as a block the invention need not be so limited and may have application to panels.

The claims defining the invention are as follows:

1. A building block or panel having the shape of a parallelepiped comprising four edge faces and two opposed major faces, each edge face being formed to be interlockingly engagable with an edge face of a similar building block, each edge face comprising a first lateral zone comprising a portion of the edge face located to one side of a central longitudinal axis of the respective edge face and a second lateral zone comprising a portion of the edge face located to the other side of the central longitudinal axis of the respective edge face, each zone of each edge face being formed with a recess and a projection disposed on each edge face wherein each recess has a base which is substantially parallel to an upper face of the projection on the respective edge face and a junction between each recess and projection at each zone defined by an end face, the end faces at each edge face being substantially parallel to each other and inclined with respect to the respective base and upper face, the first zone on each edge face being of complementary configuration to the second zone on the respective edge face.

2. A building block or panel as claimed at claim 1 wherein the configuration of a first pair of opposed edge faces are of corresponding configuration in which the formation of each zone on one edge face is reversed in relation to the formation in the corresponding zone of the opposed edge face.

3. A building block or panel as claimed at claim 1 wherein the configuration of the second pair of opposed edge faces are of complementary configuration.

4. A building block or panel as claimed at claim 1 wherein each opposed end face is substantially co-planar.

5. A building block or panel as claimed at claim 4 wherein, one end face is inclined at an angle of 45° to the edge face and the other end face is inclined at an angle of 135° to the edge face.

6. A block or panel as claimed at claim 4 wherein the recess has a width substantially corresponding to the width of the first zone.

7. A block or panel as claimed at claim 4 wherein a longitudinal face defined between the adjacent projection and recess of adjacent zones is inclined from the central plane which intersects all of the edge faces and which includes the central longitudinal axis of each edge face.

8. A block or panel as claimed at claim 4 wherein the open face of each recess which is opposed relation to the base is located substantially centrally along the respective edge face.

9. A building block or panel as claimed in claim 1 wherein, one end face is inclined at an angle of 45° to the edge face and the other end face is inclined at an angle of 135° to the edge face.

10. A block or panel as claimed at claim 9 wherein the open face of each recess which is opposed relation to the base is located substantially centrally along the respective edge face.

11. A block or panel as claimed at claim 9 wherein a longitudinal face defined between the adjacent projection and recess of adjacent zones is inclined from the central plane which intersects all of the edge faces and which includes the central longitudinal axis of each edge face.

12. A block or panel as claimed at claim 9 wherein the recess has a width substantially corresponding to the width of the first zone.

13. A block or panel as claimed at claim 1 wherein the open face of each recess which is opposed relation to the base is located substantially centrally along the respective edge face.

14. A block or panel as claimed at claim 1 wherein a longitudinal face defined between the adjacent projection and recess of adjacent zones is inclined from a central plane which intersects all of the edge faces and includes the central longitudinal axis of each edge face.

15. A block or panel as claimed at claim 14 wherein the recess has a width substantially corresponding to the width of the first zone.

16. A building block or panel as claimed at 2 wherein the configuration of the second pair of opposed edge faces are of complementary configuration.

17. A building block or panel as claimed at claim 2 wherein each opposed end face is substantially co-planar.

18. A block or panel as claimed at claim 2 wherein the recess has a width substantially corresponding to the width of the first zone.

19. A building block or panel as claimed at claim 2 wherein, one end face is inclined at an angle of 45° to the edge face and the other end face is inclined at an angle of 135° to the edge face.

20. A block or panel as claimed at claim 2 wherein the open face of each recess which is opposed relation to the base is located substantially centrally along the respective edge face.

21. A block or panel as claimed at claim 2 wherein a longitudinal face defined between the adjacent projection and recess of adjacent zones is inclined from the central plane which intersects all of the edge faces and which includes the central longitudinal axis of each edge face.

22. A block or panel as claimed at claim 3 wherein a longitudinal face defined between the adjacent projection and recess of adjacent zones is inclined from the central plane which intersects all of the edge faces and which includes the central longitudinal axis of each edge face.

23. A block or panel as claimed at claim 3 wherein the recess has a width substantially corresponding to the width of the first zone.

24. A building block or panel as claimed at claim 3 wherein each opposed end face is substantially co-planar.

25. A building block or panel as claimed at claim 3 wherein, one end face is inclined at an angle of 45° to the edge face and the other end face is inclined at an angle of 135° to the edge face.

26. A block or panel as claimed at claim 3 wherein the open face of each recess which is opposed relation to the base is located substantially centrally along the respective edge face.

27. A block or panel as claimed at claim 1 wherein the recess has a width substantially corresponding to the width of the first zone.

28. A block or panel as claimed at claim 13 wherein a longitudinal face defined between the adjacent projection and recess of adjacent zones is inclined from the central plane which intersects all of the edge faces and which includes the central longitudinal axis of each edge face.

29. A building block or panel having a shape of a parallelepiped comprising four edge faces and two opposed major faces, said edge faces being formed to be interlockingly engagable with the edge faces of similar building blocks, each edge face comprising a first lateral zone located to one side of a central longitudinal axis of the respective edge face and a second lateral zone located to the other side of the central longitudinal axis of the respective edge face, the first zone of each edge face being formed with a recess and the second zone of each edge face being formed with a projection of a complementary configuration to the recess of the first zone, the recesses on opposed edge faces being of corresponding configuration wherein, each recess has a base which is substantially parallel to the respective edge face, the open face of each recess which is in opposed relationship to the base is located substantially centrally along the respective zone, each recess has opposed end faces which are of complementary profile, are substantially parallel to each other and are inclined with respect to the edge face, the recess having a width substantially corresponding to the width of the first zone.

30. A building block or panel as claimed at claim 29 wherein the configuration of a first pair of opposed edge faces are of corresponding configuration in which the formation of each zone on one edge face is reversed in relation to the formation in the corresponding zone of the opposed edge face.

31. A building block or panel as claimed at claim 29 wherein the configuration of the second pair of opposed edge faces are of complementary configuration.

32. A building block or panel as claimed at claim 29 wherein each opposed end face is substantially co-planar.

33. A building block or panel as claimed at claim 29 wherein, one end face is inclined at an angle of 45° to the edge face and the other end face is inclined at an angle of 135° to the edge face.

34. A block or panel as claimed at claim 29 wherein a longitudinal face defined between the adjacent projection and recess of adjacent zones is inclined from the central plane which intersects all of the edge faces and includes the central longitudinal axis of each edge face.

* * * * *